US009861123B2

(12) United States Patent
Kaljura

(10) Patent No.: US 9,861,123 B2
(45) Date of Patent: Jan. 9, 2018

(54) SMOKING ARTICLE AND A METHOD OF MANUFACTURING A SMOKING ARTICLE

(71) Applicant: British American Tobacco (Investments) Limited, London (GB)

(72) Inventor: Karl Kaljura, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/432,422

(22) PCT Filed: Oct. 2, 2013

(86) PCT No.: PCT/GB2013/052562
§ 371 (c)(1),
(2) Date: Mar. 30, 2015

(87) PCT Pub. No.: WO2014/053829
PCT Pub. Date: Apr. 10, 2014

(65) Prior Publication Data

US 2015/0351451 A1 Dec. 10, 2015

(30) Foreign Application Priority Data

Oct. 3, 2012 (GB) ..... 1217682.2

(51) Int. Cl.
*A24C 5/34* (2006.01)
*A24D 3/04* (2006.01)

(52) U.S. Cl.
CPC ..... *A24D 3/041* (2013.01); *A24D 3/043* (2013.01)

(58) Field of Classification Search
None
See application file for complete search history.

(56) References Cited

U.S. PATENT DOCUMENTS 3,359,988 A * 12/1967 Thomson ..... A24D 3/041 131/336
4,532,943 A * 8/1985 Nichols ..... A24D 3/041 131/198.1

(Continued)

FOREIGN PATENT DOCUMENTS

EP 0105683 A1 4/1984
EP 0260789 A1 3/1988

(Continued)

OTHER PUBLICATIONS

International Search Report and Written Opinion, dated Mar. 21, 2014 for PCT/GB2013/052562, filed Oct. 2, 2013.

(Continued)

*Primary Examiner* — Michael H Wilson
*Assistant Examiner* — Phu Nguyen
(74) *Attorney, Agent, or Firm* — Cantor Colburn LLP

(57) ABSTRACT

A smoking article comprises a first filter section, and a second filter section located downstream of the first filter section. The first filter section comprises a material with a first pressure drop per unit length, the second filter section comprises a material with a second pressure drop per unit length, and the second pressure drop per unit length is greater than the first pressure drop per unit length. The smoking article comprises a ventilation system configured to selectively provide ingress of a variable level of ventilating air.

14 Claims, 2 Drawing Sheets

(56) References Cited

U.S. PATENT DOCUMENTS

| | | | | |
|---|---|---|---|---|
| 4,649,945 | A | 3/1987 | Norman et al. | |
| 4,687,009 | A | 8/1987 | Nichols | |
| 4,898,190 | A | 2/1990 | Deal | |
| 2005/0076927 | A1* | 4/2005 | Schluter | A24D 3/043 131/339 |
| 2006/0011206 | A1* | 1/2006 | Clarke | A24D 3/04 131/338 |
| 2008/0216851 | A1 | 9/2008 | Olegario et al. | |

FOREIGN PATENT DOCUMENTS

| | | | |
|---|---|---|---|
| GB | 2394394 | A | 4/2004 |
| WO | 02069745 | A1 | 9/2002 |
| WO | 2011117754 | A2 | 9/2011 |

OTHER PUBLICATIONS

International Preliminary Report on Patentability, dated Oct. 31, 2014 for PCT/GB2013/052562, filed Oct. 2, 2013.

* cited by examiner

SMOKING ARTICLE AND A METHOD OF MANUFACTURING A SMOKING ARTICLE

CLAIM FOR PRIORITY

This application is the National Stage of International Application No. PCT/GB2013/052562, filed Oct. 2, 2013, which in turn claims priority to and benefit of United Kingdon Patent Application No, GB1217682.2, filed Oct. 3, 2012. The entire contents of the aforementioned applications are herein expressly incorporated by reference.

TECHNICAL FIELD

Embodiments of the invention relate to a smoking article and a method of manufacturing a smoking article.

BACKGROUND

U.S. Pat. No. 4,699,158 describes a smoking article which can be adjusted by rotation to vary air dilution, by varying the degree of rotation between openings. However, this smoking article may provide a resistance to draw which is substantially reduced when ventilation is increased.

The resistance to draw of a smoking article is a measure of the pressure required to force smoke through the smoking article at a certain specified rate. A smoking article can be configured by the manufacturing process to have a resistance to draw within a pre-defined range. The resistance to draw through a variable ventilation smoking article generally drops with increased ventilation.

SUMMARY

Embodiments of the invention provide, in a first aspect, a smoking article comprising: a first filter section, and a second filter section located downstream of the first filter section; wherein the first filter section comprises a material with a first pressure drop per unit length, the second filter section comprises a material with a second pressure drop per unit length, and the second pressure drop per unit length is greater than the first pressure drop per unit length; and the smoking article comprises a ventilation system configured to selectively provide ingress of a variable level of ventilating air.

Embodiments of the invention provide, in a second aspect, a method of manufacturing a smoking article, the method comprising: forming a first filter section with a first pressure drop per unit length, forming a separate second filter section with a second pressure drop per unit length, wherein the second pressure drop per unit length is greater than the first pressure drop per unit length, and assembling the first filter section and second filter section with one or more additional components to form the smoking article, wherein the smoking article is configured to allow the ingress of a selectively variable amount of air.

BRIEF DESCRIPTION OF THE DRAWINGS

Various embodiments of the invention will now be described, by way of example only, with reference to the accompanying drawings, in which.

DETAILED DESCRIPTION

Figure 1:
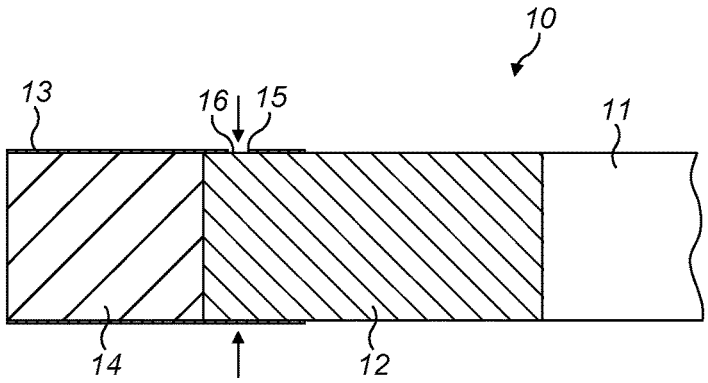
FIG. 1 is a longitudinal cross-sectional view of a part of a smoking article according to any embodiment of the invention.

FIG. 1 shows a smoking article 10 according to any embodiment. The smoking article 10 is an article such as a cigarette, cigar or cigarillo, whether based on tobacco, tobacco derivatives, expanded tobacco, reconstituted tobacco or tobacco substitutes and also heat-not-burn products (i.e. products in which flavour is generated from a smoking material by the application of heat without causing combustion of the material). For convenience, these will be referred to as "smoking articles" in this specification.

The smoking article 10 comprises a first part comprising a source of smokable material, such as tobacco. The source of smokable material is in the form of a tobacco rod 11, which is attached to a first filter section 12. The tobacco rod 11 and first filter section 12 are connected with a covering layer to affix the first filter section to the tobacco rod, which is formed of tipping paper. The tobacco rod 11 and first filter section 12 are referred to as a tobacco unit. The elongate tobacco rod 11 and first filter section 12 define a longitudinal axis of the smoking article.

The second part further comprises a sleeve 13 movable relative to the first part of the smoking article. The sleeve is in the form of a tube extending around the circumference of the tobacco rod 11 and/or first filter section 12. The tube can be cylindrical. The sleeve 13 is formed of paper. The second filter section 14 is securely attached and fixed within the sleeve. The first and second filter sections 12,14 each comprise filtration material which is wrapped in a sheet material, which may be paper, e.g. plugwrap. The first filter section 12 is upstream of the second filter section 14. The second filter section 14 is at a mouth end of the sleeve 13, adjacent to, and separate from, the first filter section 12. Alternatively, the first and second filter sections are connected.

The tobacco rod 11 and attached first filter section 12 are described as connected by tipping paper (not shown). The tipping paper is a standard tipping paper, or a relatively thick recessed tipping paper, or a board type tipping paper.

The smoking article 10 is provided with a ventilation system configured to allow adjustment of a ventilation of the smoking article 10. The ventilation system comprises one or more second ventilation area 15 on the sleeve 13, upstream of the second filter section 14. The smoking article further comprises one or more first ventilation area 16 around the first filter section 12. For example, the one or more first ventilation area 16 is defined by a layer(s) of sheet material around the first filter section or around the filtration material of the first filter section. The ventilation system provides for ventilating air to enter into the first filter section. The terms "upstream" and "downstream" are relative to the direction of the passage of smoke along the longitudinal axis of the smoking article 10, i.e. "downstream" indicates in a direction toward the mouth end of the smoking article 10.

Ventilation areas 15,16 are formed as ventilation apertures or air permeable material. In some embodiments, when ventilation areas 15 on the sleeve 13 are exposed, air can flow into the body of the smoking article 10. In some embodiments, when second ventilation areas 15 on the sleeve 13 and the corresponding first ventilation areas 16 around the first filter section 12 are aligned, air can flow into the body of the smoking article 10. In some examples, ventilation areas 15,16 are aligned by rotation of the first part of the smoking article relative to the second part. In particular, the ventilation is controlled by rotation of the sleeve 13 relative to the first filter section 12. The ventilation system provides a selectable variable level of ventilation controlled by adjusting the overlap of the second ventilation area 15 with the first ventilation area 16. The amount of ventilation depends on the effective ventilating area, which is determined by the area of the overlap of the first and second ventilation areas. The level of ventilation can be selected by selecting a position of the second part relative to the first part e.g. by rotation of the second part relative to the first part. Thus, the ventilation system provides for a variable size of effective ventilation area, providing a variable intake of air, substantially upstream of the second filter section.

The first filter section 12 and second filter section 14 are made of a known filtration material. The filtration material for both filter sections can be tow, for example, cellulose acetate tow. The filtration material of the first filter section is homogenous, and independently, the filtration material of the second filter section is homogenous. The term "homogenous" is used to mean that the filtration material is substantially uniform throughout each filter section, and in particular, is uniform in a longitudinal and/or radial direction through each of the first and second filter sections 12,14. At least one physical property of the homogenous first filter section is different to the homogenous second filter section.

The first filter section 12 provides a first closed resistance to draw or pressure drop. The first pressure drop is determined by the filtration material of the first filter section. The first resistance to draw indicates the pressure required to draw smoke through the first filter section 12 at a particular rate. The term "pressure drop" can be used in place of "resistance to draw". Pressure drop can be given in units of distance height of water ($mmH_2O/mm$). The first filter section has a first pressure drop per unit length, or resistance to draw per unit length, is constant in a longitudinal direction through the first filter section 12. Pressure drop per unit length is given per millimetre, i.e. in units of $mmH_2O/mm$. The first pressure drop per unit length is determined by the filtration material of the first filter section.

The second filter section 14 has a second pressure drop per unit length, determined by the filtration material of the second filter section 14. The second filter section 14 defines a second closed resistance to draw or pressure drop. The second pressure drop or resistance to draw indicates the pressure required to draw smoke through the second filter section 14 at a particular rate. The second resistance to draw (or pressure drop) per unit length is constant in a longitudinal direction through the second filter section 14. The second filter section 14 can be considered as comprising a filtration material having a second pressure drop per unit length.

In aspects of the present invention, the pressure drop per unit length of the second filter section 14 is greater than the pressure drop per unit length of the first filter section 12. In another aspect, the tow weight of the second filter section 14 is greater than the tow weight of the first filter section 12. The second density provided by the second filter section 14 is greater than the first density provided by the first filter section 12. The resistance to draw per unit length of the second filter section is greater than the resistance to draw of per unit length of the first filter section. Optionally, the second resistance to draw of the second filter section is greater than the first resistance to draw of the first filter section.

The one or more first ventilation areas allowing selectable ventilation are upstream of the second filter section 14. The relatively high pressure drop per unit length downstream of the ventilation area 15 provides a relatively low variation in the overall resistance to draw through the full length of the smoking article 10, as ventilation is varied.

The variable ventilation areas 15 are located substantially upstream of the second filter section 14. Ventilation of a smoking article 10 reduces the resistance to draw or pressure drop through the length of the smoking article 10. The ingress of ventilating air reduces the volume of air drawn through the smoking article 10 upstream of the ventilation areas, reducing the volume of air which experiences the resistance upstream of the ventilating areas. The ventilating air enters directly with substantially no resistance, so the overall resistance to draw or pressure drop is reduced. In particular, the ingress of air through the ventilation areas 15 reduces the resistance to draw through the section of the smoking article 10 upstream of the ventilation areas 15. The resistance to draw through the smoking article 10 downstream of the ventilation areas 15 is unchanged by variations in ventilation.

The relatively high pressure drop or resistance to draw provided by the higher density of the second filter section 14 (relative to the first filter section 12) downstream of the ventilation areas 15 provides a majority (over half) of the overall resistance to draw through the full length of the filter. Alternatively, the second filter section 14 defines a majority of the overall resistance to draw or pressure drop of the smoking article 10, including the source of smokable material (tobacco rod). The contribution of the one or more sections upstream of the ventilation area 15 on the overall resistance to draw is smaller by comparison. The ingress of air reduces the resistance to draw or pressure drop for the upstream section only, and the downstream section with a higher resistance to draw or pressure drop is unaffected by the ventilation. Therefore, a relatively high part of the overall resistance to draw through the smoking article 10 is not changed by the change in ventilation of the smoking article 10. The increased density of the second filter section 14 downstream of the ventilation areas 15 provides a reduction in the effect of an increased ventilation on the overall resistance to draw through the full length of the smoking article 10.

As the level of ventilation is varied, the resistance to draw air through the smoking article 10 also changes. As the amount of ventilating air entering the smoking article 10 increases, the overall resistance to draw decreases. The relatively high pressure drop or resistance to draw of the second filter section 14 (e.g. achieved with a relatively high density of filter material) provides a relatively low change in overall resistance to draw caused by an increased level of ventilation. Therefore, as the level of ventilation is varied over a range selectable by the user, the pressure drop or resistance to draw through the smoking article 10 varies over a relatively small range as a result of the higher density of the second filter section 14. Thus, the pressure drop of the smoking article is more constant as the ventilation is varied.

In some examples of the invention, the first filter section has a pressure drop per unit length of less than 5 $mmH_2O/mm$. Alternatively, the first filter section has a pressure drop per unit length of less than a value selected from: 4 $mmH_2O/mm$, 3 $mmH_2O/mm$, 2 $mmH_2O/mm$, 1.5 $mmH_2O/mm$, and 1 $mmH_2O/mm$.

In some examples of the invention, the second filter section has a pressure drop per unit length of more than 5 mm $H_2O$. Alternatively, the second filter section has a pressure drop per unit length of more than a value selected from: 6 mm $_2O$/mm, 7 mm $H_2O$/mm, 8 mm $_2O$/mm, 9 mm$H_2O$/mm, 10 mm$H_2O$/mm, 11 mm$H_2O$/mm, and 12 mm$H_2O$/mm.

In some aspects, the pressure drop per unit length of the first filter section is between 1 and 5 mm$H_2O$/mm, and the pressure drop per unit length of the second filter section is between 5 and 15 mm$H_2O$/mm. In some examples, the pressure drop per unit length of the first filter section is less than 5 mm$H_2O$/mm, and the pressure drop per unit length of the second filter section is more than 5 mm$H_2O$/mm. The upstream filter section has a pressure drop per unit length which is lower than a pressure drop per unit length of the downstream filter section. The upstream filter section has a pressure drop per unit length which is lower than any of the example values specified, and a pressure drop per unit length of the downstream filter section is higher than any of the example values specified.

In some examples, the pressure drop per unit length of the second filter section is higher than the first filter section by at least a multiple value selected from one of: 2, 3, 4, 5, 6, 7, 8, 9, 10, 11, 12, 13, 14 and 15.

For example, the second pressure drop per unit length of the second filter section is between 2 and 15 times greater than the first density of the first filter section, and optionally the second pressure drop per unit length of the second filter section is between 5 and 12 times greater than the first pressure drop per unit length of the first filter section.

Figure 2:
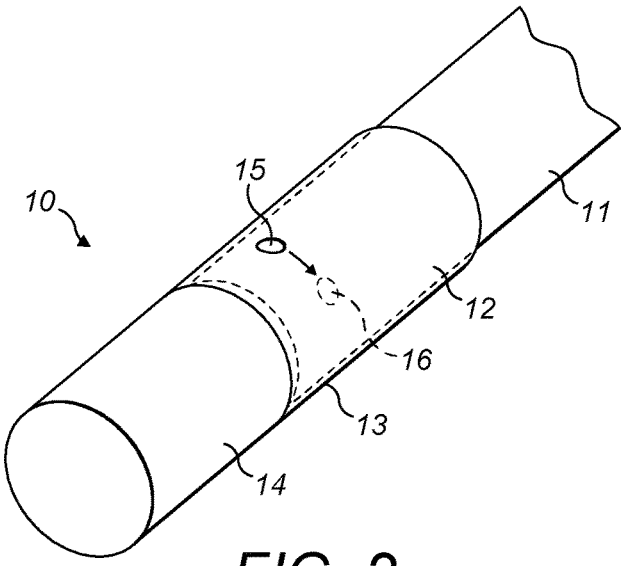
FIG. 2 is a perspective view of a part of a smoking article according to a first embodiment of the invention.

The pressure drop per unit length of the first and second filter sections is determined (at least partially) by the physical structure of the filtration material forming the filter sections. The first and second filter sections can both comprise fibrous material, comprising tow filaments. For a filtration material comprising tow filaments, the pressure drop per unit length can be determined by the amount or number of tow filaments in a particular volume or length. The tow weight is a measure of the amount of tow fibres in a certain volume. The pressure drop per unit length can also be determined by the cross-section of the tow filaments. For example, the tow filaments can have an X-shaped cross-section or a Y-shaped cross-section. The cross-sectional area can also affect the pressure drop per unit length. The tow weight can provides an indication of the density of a fibrous material within the filter section. The pressure drop per unit length can also be determined by the amount or degree of crimping (i.e. folding) of the filaments, during the manufacturing processes. These factors affecting the pressure drop per unit length of the filter sections are known, and can be selected to obtain the required pressure drop per unit length for each of the first and second filter sections individually. Thus, the first and second filter sections comprise filtration material which has a physical property determined by a different selection of any one or more of the above characteristics. The first and second filter sections are manufactured using filtration material formed or treated to have the required properties, for example as above, providing the different pressure drop per unit length for the first and second filter sections. FIG. 2 shows the tobacco rod 11 and first filter section 12 are dimensioned to rotate as a unit around a longitudinal axis within the sleeve 13. A restraining means (not shown) retains the first part and second part in a fixed longitudinal arrangement, and prevents extension of the smoking article 10. Thus, the first part cannot slide longitudinally relative to the second part, i.e. the sleeve is not movable longitudinally relative to the tobacco unit.

The level of ventilation can be selected by selecting an angular position of the sleeve 13 relative to the first filter section 12.

In some examples, the ventilation areas 15 are configured to increase in size non-linearly with respect to angular position. The ventilation areas 15 are configured such that the level of ventilation has a substantially linear dependence on the angular position of the sleeve 13 relative to the first filter section 12.

In some aspects, the one or more ventilation areas 15 maintain a fixed longitudinal position relative to the first and second filter sections, when the sleeve 13 is rotated relative to the first filter section 12.

In the present embodiment, the second filter section 14 is securely attached and fixed within the sleeve 13. Rotation of the second filter section 14 causes a corresponding rotation of the sleeve 13 relative the first filter section 12.

By selecting a different angular position of the second filter section 14 relative to the first filter section 12, the registry between the ventilation areas 15 in the sleeve 13 and the ventilation areas 16 in the sheet material or plugwrap around the first filter section 12 can be selectively increased or decreased. The level of ventilation in the smoking article 10 can therefore be increased or decreased.

Figure 3:
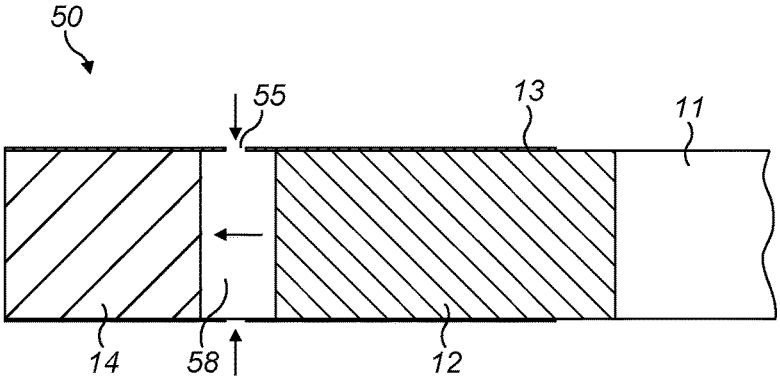
FIG. 3 is a side elevation view of a smoking article according to a second embodiment of the invention.

FIG. 3 shows a smoking article 50 according to a second embodiment. The overall layout is similar to the first embodiment described above, the same parts having the same reference numerals, and parts other than those described remaining unchanged.

In the embodiment of FIG. 3, the second filter section 14 is securely attached and fixed within the tubular sleeve 13. The tobacco rod 11 and first filter section 12 are dimensioned to slide as a unit along a longitudinal axis within the sleeve 13. Ventilation is varied by sliding the tobacco unit within the sleeve, not by rotation as previously described for the first embodiment. One or more ventilation areas are configured to overlap to determine the level of ventilation of the smoking article.

The sleeve 13 comprises one or more ventilation areas 55 comprising ventilation apertures or air permeable material, upstream of the second filter section. The sleeve 13 is generally impermeable to air, such that air can only flow into the body of the smoking article 10 through the one or more ventilation areas. In one example, first ventilation apertures 55 comprises a plurality of longitudinally spaced apertures. The apertures 55 are selectively blocked and closed to ingress off air by an impermeable outer surface of the tobacco unit, which is moveable longitudinally within the sleeve. The variable intake of air is substantially upstream of the second filter section.

Alternatively, the sheet material or plugwrap around the first filter section 12 comprises a set of ventilation areas comprising ventilation apertures or air permeable material. When ventilation apertures 55 on the sleeve and corresponding ventilation areas (not shown) on the sheet material or plugwrap around the first filter section 12 are aligned, air can flow into the body of the first filter section 12. The ventilation areas are aligned by sliding the sleeve 13 relative to the first filter section 12. The level of ventilation can be selected by selecting a longitudinal position of the sleeve 13 relative to the first filter section 12.

In some examples, ingress of air is through the ventilation apertures 55 in the sleeve 13 is into a variable length chamber 58 between the second filter section 14 and the first filter section 12. Alternatively, the ingress of ventilating air is directly into the first filter section, for example, through one or more further ventilation areas (not shown) around the first filter section. By selecting a different longitudinal distance between the second filter section 14 and the first filter section 12, the user can increase or decrease the registry between the open area of the ventilation apertures 55 in the sleeve 13 The relative filter resistances to draw and filter densities are as described for the first embodiment.

EXAMPLE

Table 1 below shows calculated values for the resistance to draw through a conventional "Smoking Article 1" compared with calculated values for the resistance to draw through an example "Smoking Article 2", according to any example of the invention. Each smoking article has a filter with total length 27 mm, and variable ventilation system allowing ingress of air at a distance 16.5 mm from the mouth end of the filter. The filter is formed of the first and second filter sections which are axially aligned. The mouth end filter section (second filter section) is 8 mm long, and the tobacco end filter section (first filter section) is 19 mm long. Both smoking articles have an identical tobacco rod with a resistance to draw (pressure drop) of 43.43 mm $H_2O$.

The conventional filter of Smoking Article 1 has a provides a substantially uniform pressure drop per unit length of approximately 5 $mmH_2O$/mm, for both first and second filter sections. The pressure drop is 85 $mmH_2O$ for the first filter section with a length of 19 mm, and a pressure drop of 40 $mmH_2O$ for the second filter section with a length of 8 mm.

In the example of Smoking Article 2, according to the invention, the second filter section is an 8 mm filter section at the mouth end of the filter, which has a pressure drop of 85 $mmH_2O$. This provides a relatively high pressure drop per unit length of 10.63 $mmH_2O$/mm. The upstream first filter section has a length of 19 mm adjacent the tobacco rod, and has a relatively low pressure drop per unit length. This provides a pressure drop per unit length of 1.05 $mmH_2O$/mm.

TABLE 1

| | Smoking Article 1 (example conventional smoking article) Pressure drop ($mmH_2O$) | Smoking Article 2 (example of invention) Pressure drop ($mmH_2O$) |
|---|---|---|
| First filter section (19 mm) PD | 85 | 20 |
| Second filter section (8 mm) PD | 40 | 85 |
| PD of filter downstream of vent | 78 | 93.95 |
| PD of filter upstream of vent | 46.97 | 11.05 |
| PD Tobacco Rod | 43.43 | 43.43 |
| Total PD at 40% ventilation | 132.27 | 126.64 |
| Total PD at 60% ventilation | 114.19 | 115.74 |
| Total PD at 80% ventilation | 96.11 | 104.84 |

Figure 4:
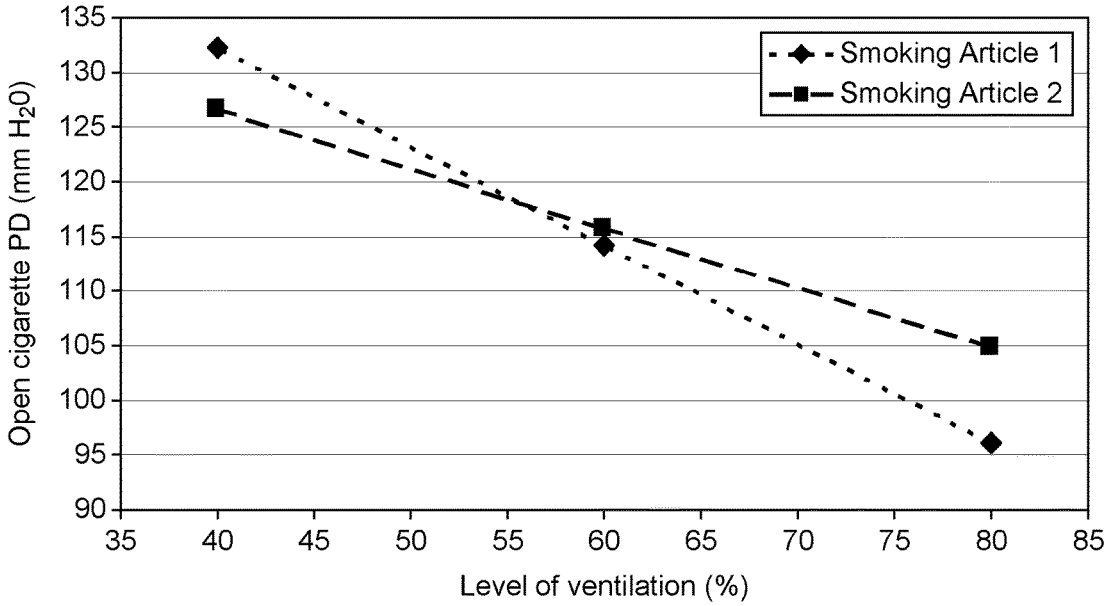
FIG. 4 is a graph showing the relationship between level of ventilation and open cigarette pressure drop (PD) for an example conventional smoking article and a smoking article according to the invention.

The pressure drop through the full smoking article (including tobacco rod) is determined for ventilation values with a level of ventilation between 40% and 80% ventilated. For the conventional Smoking Article 1 the pressure drop varies from 132.27 to 96.11 $mmH_2O$ ventilation as ventilation increases. However, in the Smoking Article 2, according to the invention, the pressure drop varies only from 126.64 $mmH_2O$ to 104.84 $mmH_2O$ over the same ventilation range. Thus, the drop of only 21.8 mm $H_2O$ provided by the invention, compared with 36.16 mm $H_2O$ for the conventional smoking article, provides a reduced change in pressure drop (i.e. more constant resistance to draw) when varying the ventilation of the smoking article. These results are illustrated in FIG. 4.

Figure 5:
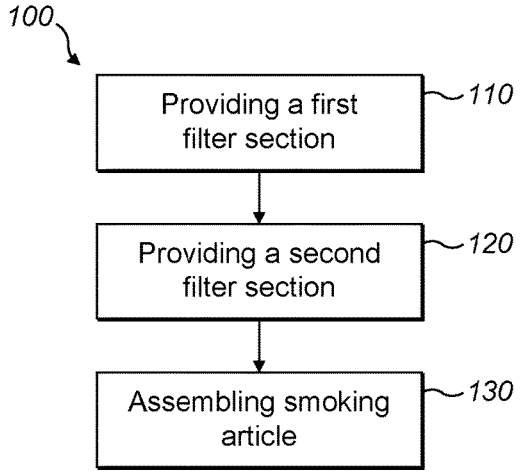
FIG. 5 is a schematic flow diagram showing a method of manufacturing a smoking article.

FIG. 5 shows schematically a method 100 of manufacturing smoking articles according to the invention. The method 100 comprises forming a first filter section with a first resistance to draw or pressure drop (step no). The first filter section is formed from a known filtration material, for example, cellulose acetate tow. A second filter section is separately produced (step 120). The second filter section is also formed from cellulose acetate tow. The pressure drop per unit length of the second filter section is greater than the pressure drop per unit length of the first filter section. Optionally, the pressure drop of the second filter section is greater than the pressure drop of the first filter section.

The different pressure drop properties of the first and second filter sections are determined during manufacturing of the first and second filter sections. In some aspects, the fibrous filtration material, i.e. tow elements are configured differently for the first and second filter sections. For example, the second filter section is formed with a different diameter tow, compressed more than the first filter section, different cross-section, to obtain the different properties (i.e. higher density). The pressure drop properties of the first and second filter sections are not substantially changed or modified during use of the smoking article.

The first filter section and second filter section are assembled with one or more additional components to form the smoking article (step 130). The first and second filter sections may be longitudinally aligned with a source of smokeable material. Any other known filter components can be added to the smoking article. Examples of further filter components include a third filter section, a filter section with particulate material (e.g. carbon, activated charcoal) or a hollow section. The first and/or second filter sections can each be considered as comprising one or more discrete filter sections. The filter sections can be considered as generally upstream and downstream of the variable ventilation area. The one or more upstream filter section has a lower pressure drop per unit length than the one or more downstream filter section.

Wrapping material is applied to the smoking article assembly to attach the component parts. The paper wrapping material is tipping paper. In addition, a sleeve is wrapped around the smoking article. The sleeve is configured to move relative to the first filter section and, optionally, is securely attached to the second filter section.

The smoking article is configured to allow the ingress of a selectively variable amount of air upstream of the second filter section. For example, ventilation apertures are formed in the outermost layer of paper wrap and/or the paper sleeve. The ventilation apertures are formed by a mechanical cutting tool or a laser. The ventilation apertures are formed in the wrapping material prior to the assembly of the smoking article (i.e. pre-perforated apertures) or, optionally, when the smoking article is assembled.

The ventilation has been described by entering the smoking article upstream of the second filter section, and in particular, into the first filter section. Alternatively, the ventilation can be at least partially into the second filter section, e.g. adjacent an upstream end of the second filter section. A ventilating position for ingress of air which includes both upstream of the second filter section and optionally an upstream part (e.g. upstream quarter) of the second filter section is termed as located substantially upstream of the second filter section.

The properties of the filter sections can be defined in terms of any of: pressure drop per unit length, resistance to draw per unit length, pressure drop, resistance to draw, tow weight, or density. The filter sections can be defined in terms of the filtration material having a resistance to draw, which can be considered as independent of the length of the filter section.

The smoking article can comprise one or more ventilation areas providing a base level of ventilation. Such ventilation areas (not shown) are not variable in size.

In order to address various issues and advance the art, the entirety of this disclosure shows by way of illustration various embodiments in which the claimed invention(s) may be practiced and provide for a superior smoking article. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article comprising:

a first filter section;

a second filter section located downstream of the first filter section, the first filter section including a material with a first pressure drop per unit length, and the second filter section including a material with a second pressure drop per unit length, the second pressure drop per unit length being greater than the first pressure drop per unit length; and a ventilation system configured to selectively provide ingress of a variable level of ventilating air further comprising a sleeve configured to move relative to the first filter section, wherein the second filter section is fixed within the sleeve, and the level of ventilation is selectable by selecting a position of the sleeve relative to the first filter section.

2. The smoking article as claimed in claim 1 wherein the ventilation system provides ingress of ventilating air substantially upstream of the second filter section.

3. The smoking article as claimed in claim 1, wherein the first filter section has a first tow weight of fibrous filtration material, and the second filter section has a second tow weight of fibrous filtration material, the second tow weight of fibrous filtration material is greater than the first tow weight of fibrous filtration material.

4. The smoking article as claimed in claim 1, wherein the pressure drop per unit length of the first filter section is less than 5 $mmH_2O/mm$, and the pressure drop per unit length of the second filter section is more than 5 $mmH_2O/$ mm.

5. The smoking article as claimed in claim 1 wherein the pressure drop per unit length of the second filter section is between 2 times greater and 15 times greater than the pressure drop per unit length of the first filter section.

6. The smoking article as claimed in claim 5, wherein the pressure drop per unit length of the second filter section is between 5 and 12 times greater than the pressure drop per unit length of the first filter section.

7. The smoking article as claimed in claim 1, wherein the first filter section includes a first homogeneous filtration material, and the second filter section includes a second homogenous filtration material.

8. The smoking article as claimed in claim 1, wherein the second filter section is separate from the first filter section and/or is moveable relative to the first filter section.

9. The smoking article as claimed claim 1, wherein a resistance to draw of the second filter section is higher than a resistance to draw of the first filter section, or is higher than the sum of the resistance to draw of the first filter section and a resistance to draw of a tobacco rod.

10. The smoking article as claimed in claim 1, section wherein the ventilation system is configured to allow ventilating air into the first filter section.

11. The smoking article as claimed in claim 1, wherein the sleeve is rotatable with respect to the first filter section, and the level of ventilation is selectable by selecting an angular position of the sleeve relative to the first filter section.

12. The smoking article as claimed in claim 1, wherein the sleeve is longitudinally extendable from the first filter section, and the level of ventilation is selectable by selecting a longitudinal position of the sleeve relative to the first filter section.

13. The smoking article as claimed in claim 1, wherein the first filter section has a length of between 14 mm and 24 mm, the second filter section has a length of between 6 mm and 10 mm, and/or the ventilating system provides ventilating air at between 12 mm and 20 mm from a mouth end of the smoking article.

14. The smoking article comprising as claimed in claim 1, wherein the first filter section and the second filter section include tow filaments, and the first filter section differs from the second filter section by one or more of: tow weight, number of tow filaments in unit volume, cross-section of tow filaments and/or degree of crimping.

* * * * *